US006554685B2

(12) United States Patent
Lish

(10) Patent No.: US 6,554,685 B2
(45) Date of Patent: Apr. 29, 2003

(54) SOFT FOLDABLE TOY

(76) Inventor: Anita H. Lish, 241 N. 500 East, American Fork, UT (US) 84003

( * ) Notice: Subject to any disclaimer, the term of this patent is extended or adjusted under 35 U.S.C. 154(b) by 0 days.

(21) Appl. No.: 09/779,332

(22) Filed: Feb. 8, 2001

(65) Prior Publication Data

US 2002/0106969 A1 Aug. 8, 2002

(51) Int. Cl.[7] ..... A63H 33/00
(52) U.S. Cl. ..... 446/487; 446/901; 5/655
(58) Field of Search ..... 446/487, 488, 446/489, 901; 273/157 R, 156; 5/655, 482, 922, 923, 413 R, 413 AM, 636

(56) References Cited

U.S. PATENT DOCUMENTS 1,333,181 A * 3/1920 Mathews
3,789,522 A * 2/1974 Moore
4,280,241 A * 7/1981 Pfaff ..... 11/1 R
4,543,278 A * 9/1985 Ackerman ..... 428/18
4,673,184 A * 6/1987 Sansores ..... 273/286
4,853,994 A * 8/1989 Ekstein ..... 5/437
4,911,670 A * 3/1990 McNicholas ..... 446/74
D308,149 S * 5/1990 Lewis et al. ..... D6/588
5,000,715 A * 3/1991 Johnson
5,472,364 A * 12/1995 Castleman ..... 446/71
5,542,870 A * 8/1996 Westersund
5,868,599 A * 2/1999 Kaufman
5,931,099 A * 8/1999 Bruner et al.
5,933,886 A * 8/1999 Washington ..... 5/494
5,961,149 A * 10/1999 Hunt ..... 281/22
5,970,541 A * 10/1999 Chiang ..... 5/420
6,000,986 A * 12/1999 Kaufman

* cited by examiner

*Primary Examiner*—Derris H. Banks
*Assistant Examiner*—Jamila Williams
(74) *Attorney, Agent, or Firm*—Clayton, Howarth & Cannon, P.C.

(57) ABSTRACT

A toy including a base made of a flexible sheet and painted or printed to have the appearance of grass, streets, rivers, lakes, and the like, and one or more structures configured for being reversibly folded into a flattened shape and unfolded to resemble houses, schools, churches, airports, and the like is described. Preferably, the structures are reversibly attachable to the base, such as with a hook-and-loop fastener.

15 Claims, 5 Drawing Sheets

SOFT FOLDABLE TOY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a child's toy. More particularly, this invention relates to a toy comprising a base painted or printed to resemble a view of grass, streets, rivers, lakes, and/or the like. The toy further comprises one or more three-dimensional objects resembling a house, farm building, business, school, church, tree, and/or the like, which can be place in selected locations on the base. The base and three-dimensional objects are made of a flexible materials such that they can be easily folded into a flat configuration for storage and transport. Further, the toy is washable such that it can be cleaned if it becomes soiled.

J. D. Moore, U.S. Pat. No. 3,789,522 (1974), describes an educational toy device including a base having a plurality of hinged panels connected to the base at its outer edge. These hinged panels can be folded into an upright position for storage or can be folded into the plane of the base for defining a work station. Each work station has sockets for receiving items of geometrical shape.

D. W. Johnson & L. C. Vonderhaar, U.S. Pat. No. 5,000,715 (1991), discloses a toy machine for laying a simulated road surface. The toy comprises an elongate flexible strip of material having front and back surfaces. The back surface carries adhesive or tacky material for attachment of the flexible strip to a floor. The front surface has markings that simulate a highway, parking lot, or landing strip. Thus, this invention provides a temporary surface that can be placed on an indoor or outdoor floor for use by a child for playing with toy automobiles or airplanes.

C. D. Westersund, U.S. Pat. No. 5,542,870 (1996), teaches a folding box dioramic toy having a rectangular base and hinged rectangular side panels. These base and panels display scenery, such as a medieval castle and outbuildings, such that a child can place and move toy archers, horse-mounted knights, and villagers. Each side panel also includes an integral triangular piece extending at a right angle to the side panel, which collectively form a closed box top when the side panels are folded into a vertical position.

S. Kaufman, U.S. Pat. No. 5,868,599 (1999), and S. Kaufman, U.S. Pat. No. 6,000,986 (1999), describe an interactive book having at least one page of text, graphics, or illustrations, wherein the page includes a track or mono-rail and a toy for moving along the track.

D. Bruner et al., U.S. Pat. No. 5,931,099 (1999), discloses a model train set including a base having two sections connected to each other to form an upper surface. This upper surface has a continuous integral track. The model train set includes at least one snap-in reversible storyboard and a plurality of visual elements. The model train set also includes a train, cars, and storage units.

W. H. Hunt, U.S. Pat. No. 5,961,149 (1999), teaches a toy train and book assembly. The covers and flaps of the book are opened and laid flat to form a base. Pop-up and fixed structures form a village, including a path or track passing through the village. A toy train stored in a storage compartment on the cover of the book can be removed, placed on the track, and allowed to run around the track and through the village.

While these toys are generally suitable for their limited purposes, they possess certain inherent deficiencies that detract from their overall utility as toys for children. For example, the toys of U.S. Pat. No. 3,789,522 and U.S. Pat. No. 5,542,870 have many hard components that can potentially be injurious to a child. By way of further example, U.S. Pat. No. 5,961,149 describes a toy with structures in fixed positions, which does not allow for as much creativity and imagination as may be desired concerning how the toy may be used.

In view of the foregoing, it will be appreciated that providing a soft, foldable, toy that permits compact storage, ease of transport, and a high level of creativity and imagination in playing with the toy would be a significant advancement in the art.

BRIEF SUMMARY OF THE INVENTION

It is an object of the present invention to provide a toy such that each component can be folded flat for ease of storage and transport.

It is also an object of the invention to provide a toy that is washable, thus facilitating cleaning when it becomes soiled.

It is another object of the invention to provide a soft toy that contains no hard pieces or edges, thus being safe for children of all ages.

It is still another object of the invention to provide a toy comprising components that can be arranged in a large variety of ways, thus engendering creativity and imagination in children that play with it.

These and other objects can be addressed by providing a toy comprising:

(a) a base comprising a flexible sheet; and (b) at least one structure configured for being reversibly folded into a flattened shape and unfolded into a shape representing a member selected from the group consisting of houses, garages, businesses, farm buildings, churches, schools, transportation terminals, trees, mountains, and the like, wherein the at least one structure is optionally configured for being releasably attached to the base.

Preferably, the base is painted or printed such that one or more portions thereof resembles at least one member selected from the group consisting of grass, streets, rivers, lakes, railroad tracks, sidewalks, parking lots, and airport runways, and the like. Further, the toy preferably further comprises means for releasably attaching at least one structure to the base. In a preferred embodiment of the invention, such means for separably attaching comprises a separable fastener, such as a hook-and-loop fastener. Still further, the base is preferably comprised of a fabric, more preferably of a woven fabric, and most preferably of a canvas material or heavy cotton duck or the like.

Another preferred embodiment of the invention comprises a toy comprising:

(a) a base comprising a fabric sheet painted or printed such that one or more portions thereof resemble at least one member selected from the group consisting of grass, streets, rivers, lakes, railroad tracks, sidewalks, parking lots, airport runways, and the like;

(b) at least one structure configured for being reversibly folded into a flattened shape and unfolded into a shape representing a member selected from the group consisting of houses, garages, businesses, farm buildings, churches, schools, transportation terminals, trees, mountains, and the like, wherein the at least one structure is optionally configured for being releasably attached to the base; and (c) at least one separable fastener comprising first and second portions thereof, wherein the first portion is disposed on the base and the second portion is disposed on the at least one structure.

Still another preferred embodiment of the invention comprises a method for using the toy described and claimed herein comprising:

(a) spreading the base on a generally flat surface;

(b) unfolding the at least one structure such that the at least one structure comprises a shape representing a member selected from the group consisting of houses, garages, businesses, farm buildings, churches, schools, transportation terminals, trees, mountains, and the like; and (c) placing the unfolded at least one structure at a selected location on the base.

In a still further preferred embodiment of the invention, this method further comprises:

(d) attaching the unfolded at least one structure to the base.

This attaching step is preferably achieved using a separable fastener, such as a hook-and-loop fastener.

DETAILED DESCRIPTION

Before the present toy is disclosed and described, it is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

The publications and other reference materials referred to herein to describe the background of the invention and to provide additional detail regarding its practice are hereby incorporated by reference. The references discussed herein are provided solely for their disclosure prior to the filing date of the present application. Nothing herein is to be construed as an admission that the inventors are not entitled to antedate such disclosure by virtue of prior invention.

It must be noted that, as used in this specification and the appended claims, the singular forms "a," "an," and "the" include plural referents unless the context clearly dictates otherwise. For example, reference to a toy comprising "a base" includes reference to two or more of such bases, reference to "a structure" includes reference to two or more of such structures, and reference to "a fabric" includes reference to two or more of such fabrics.

In describing and claiming the present invention, the following terminology will be used in accordance with the definitions set out below.

As used herein, "comprising," "including," "containing," "characterized by," and grammatical equivalents thereof are inclusive or open-ended terms that do not exclude additional, unrecited elements or method steps. "Comprising" is to be interpreted as including the more restrictive terms "consisting of" and "consisting essentially of."

As used herein, "consisting of" and grammatical equivalents thereof exclude any element, step, or ingredient not specified in the claim.

As used herein, "consisting essentially of" and grammatical equivalents thereof limit the scope of a claim to the specified materials or steps and those that do not materially affect the basic and novel characteristic or characteristics of the claimed invention.

As used herein, "transportation terminals" means airport terminals, train stations, bus terminals, boat docks, and the like.

As used herein, "farm buildings" means farm houses, barns, silos, sheds, and the like.

As used herein, "streets" means streets, roads, highways, lanes, avenues, boulevards, and the like.

Figure 1:
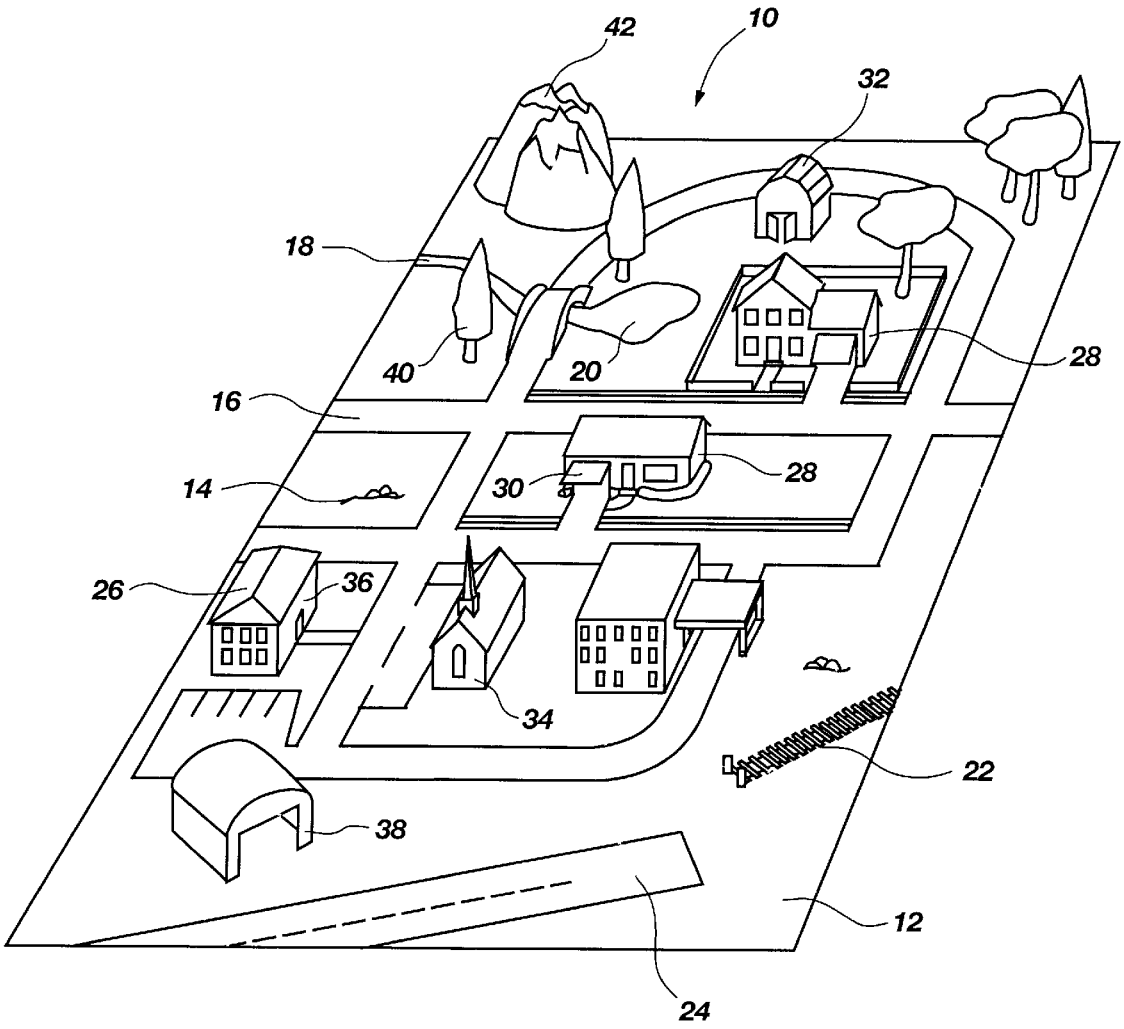
FIG. 1 shows a perspective view of an illustrative toy according to the present invention.

FIG. 1 shows an illustrative toy 10 according to the present invention. The toy comprises a base 12 comprising a flexible sheet. This sheet is preferably made of a material that is both foldable and washable. Thus, the base can be folded into a compact form for storage or transport. Moreover, the washability of the base allows for cleaning when the base becomes soiled. Preferably, the base is composed of a fabric material or a plastic material. More preferably, the base is composed of a woven fabric, such as a canvas material, heavy cotton duck, or the like. Most preferably, the base is machine washable for ease and thoroughness of washing. The base is preferably painted or printed such that it appears to have features thereon such as grass 14, streets 16, rivers 18, lakes 20, railroad tracks 22, and airport runways 24, and the like.

The toy further comprises at least one structure 26 configured for being reversibly folded into a flattened shape and unfolded into a shape representing a member selected from the group consisting of houses 28, garages 30, farm buildings 32, churches 34, schools 36, transportation terminals 38, trees 40, and mountains 42, and the like. The structure is preferably configured for being releasably attached to the base. This releasable attachment can be by means of any suitable attachment mechanism known in the art. For example, a separable fastener can be used for attaching the structure to the base. With a separable fastener, one component 80 of the separable fastener is disposed on the base and another component 81 of the separable fastener is disposed on the structure, the two components being attachable to each other. An illustrative type of separable fastener that may be used in the present invention is a hook-and-loop fastener. The structure is preferably made of a fabric or combination of fabrics, such as a woven, knitted, or felted fabric. The fabric may also be painted or printed to provide the appearance of details such as doors, windows, shingles, and the like. It is also within the scope of the invention for the windows, doors, garage doors, barn doors, and the like to open, as will be described in more detail below.

Figure 2:
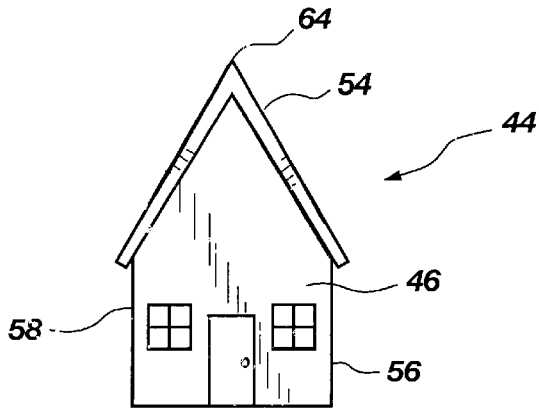
FIG. 2 shows a front elevation view of an illustrative structure according to the present invention wherein the structure is in unfolded or expanded form.
Figure 3:
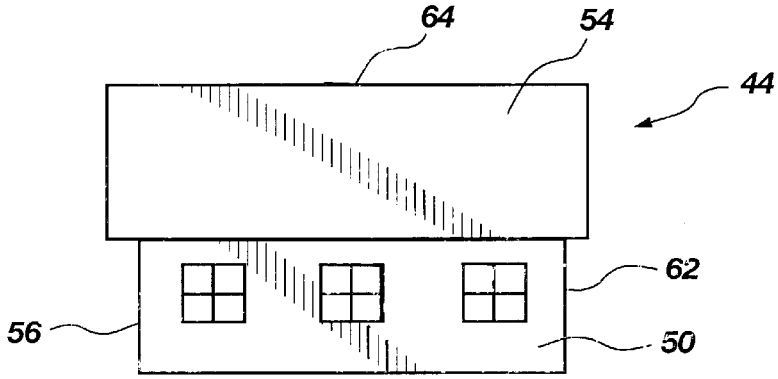
FIG. 3 shows a side elevation view of the illustrative structure of FIG. 2.
Figure 4:
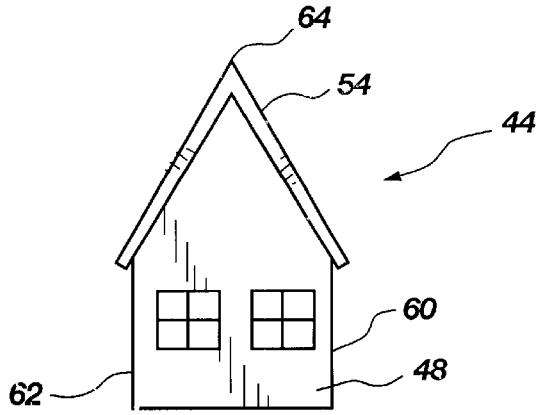
FIG. 4 shows a back elevation view of the illustrative structure of FIG. 2.
Figure 5:
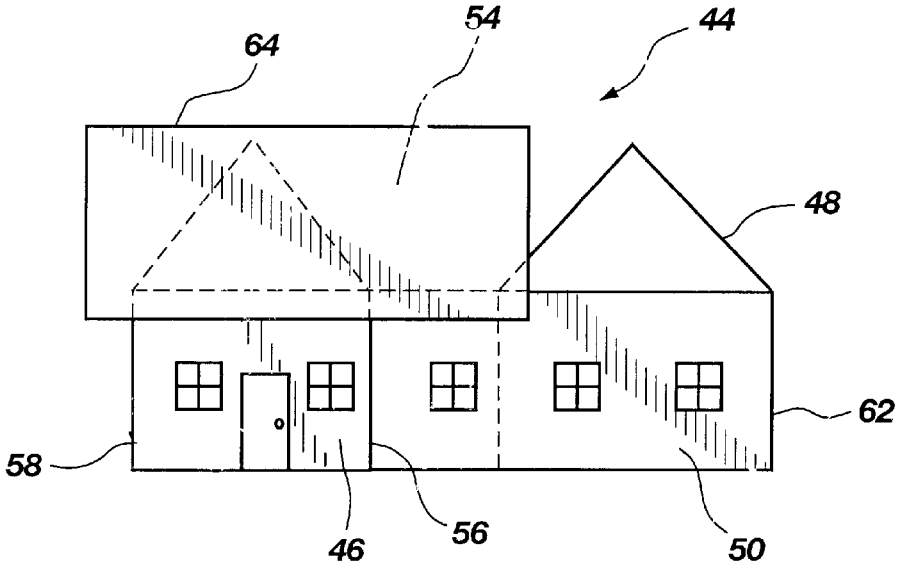
FIG. 5 shows a side elevation view of the illustrative structure of FIG. 2 in folded form.
Figure 6:
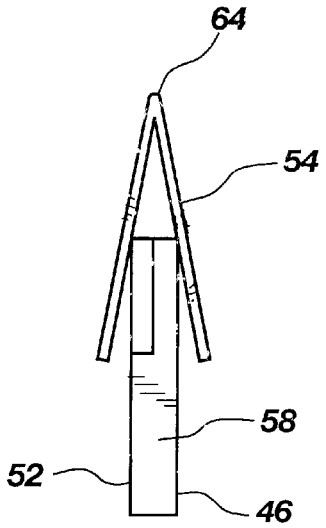
FIG. 6 shows an end view of the illustrative structure of FIG. 5.

FIGS. 2–4 show an illustrative structure 44 according to the present invention, wherein the structure is in unfolded or expanded form. FIGS. 5–6 show this structure 44 in folded or flattened form. Preferably, the structure is composed of components that are attached to each other such that the structure comprises a unitary member. This gives the advantages that the structure will be more sturdy than if it were composed of separable components, and the components will not be lost. For example, the structure 44 of FIGS. 2–6 comprises a front wall 46, back wall 48, side walls 50 and 52, and a roof 54. Each of these walls is coupled to two adjoining walls by a joint 56, 58, 60, 62. The roof is preferably attached to only one of the walls. It is also within the scope of the invention, however, to attach the roof to more than one wall. It is also within the scope of the invention to provide structures having additional features, such as porches, carports, awnings, and the like. The structure is placed in flattened or folded form by opening two opposite joints to approximately 180° and closing the other two opposite joints to approximately 0°. The ridge 64 of the roof can then be folded, thus placing the structure in the flattened form shown in FIGS. 5–6.

Figure 7:
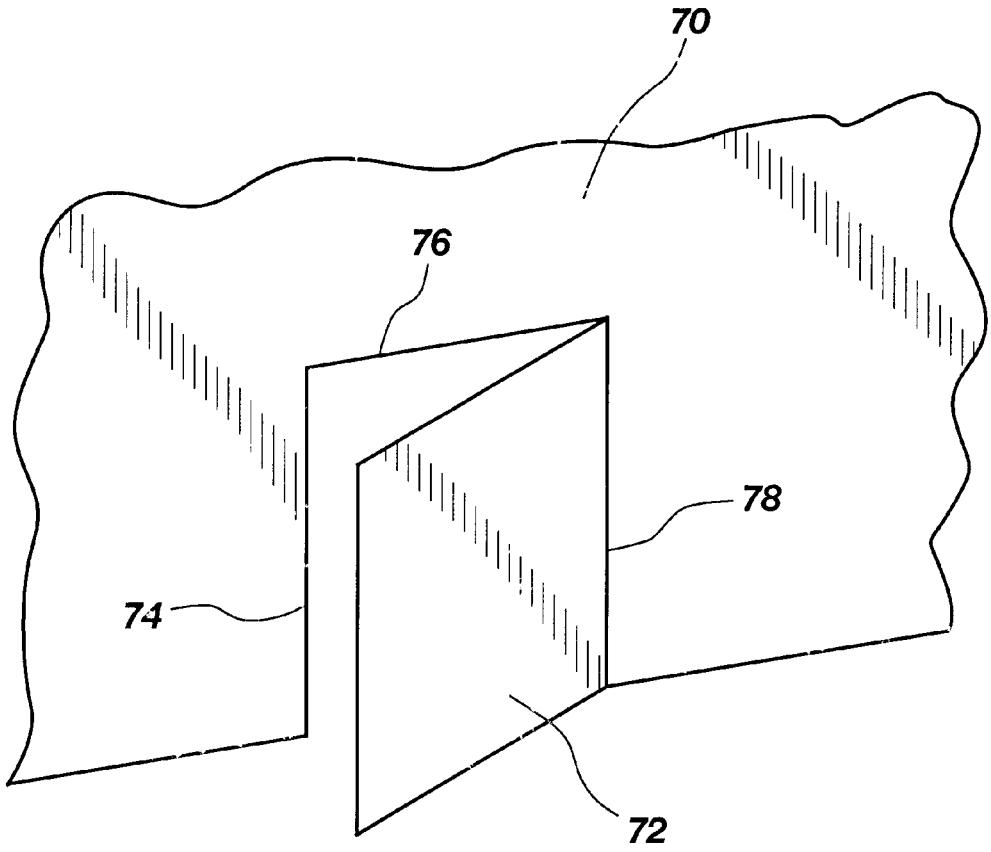
FIG. 7 shows a perspective view of a portion of a wall of a structure according to the present invention.
Figure 8:
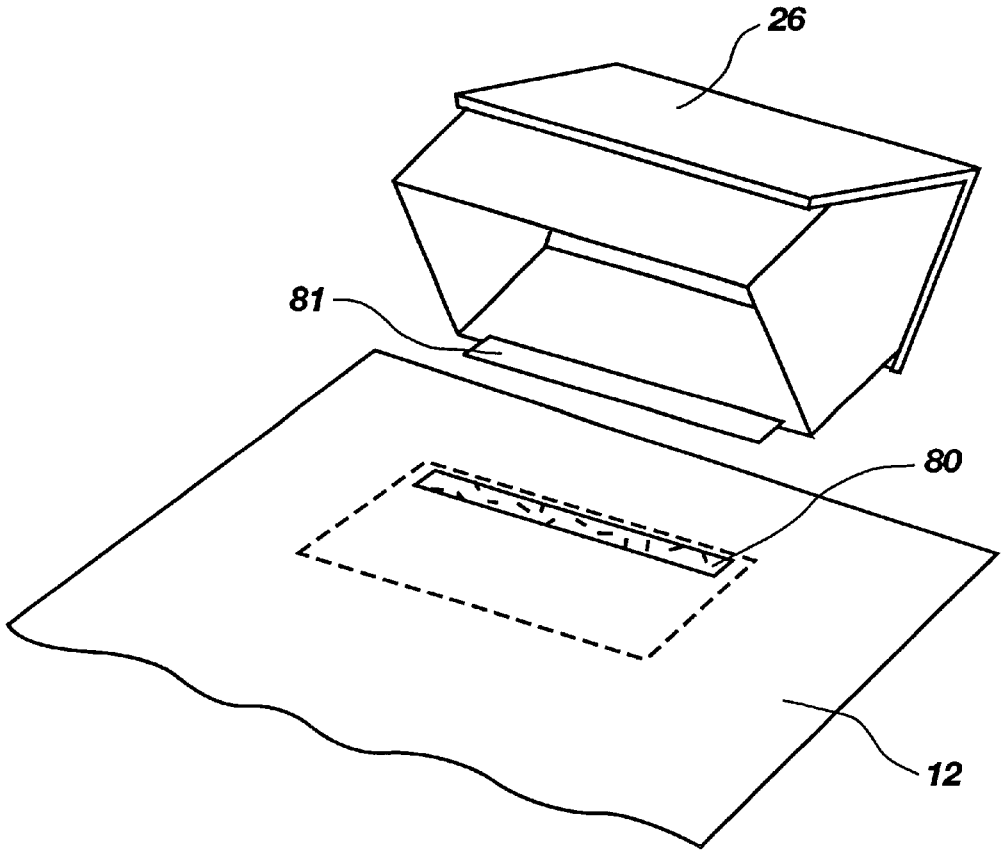
FIG. 8 shows the separable fasteners disposed on the base and structure.

FIG. 7 shows a portion of a wall 70 of an illustrative structure according to the present invention. The wall 70 comprises a door 72 formed in the wall such that the door can be opened and closed. The door can be thought of as being formed from a vertical cut 74 in the wall coupled to a horizontal cut 76 in the wall. The junction 78 between the door and the wall functions as a hinge for permitting the door to open and close. Using similar principles, garage doors, windows, and other features can be formed in the structures of the present invention.

The walls and roof are preferably fabricated by cutting pieces of fabric into selected shapes and joining the pieces, such as by sewing them together. It is preferable to provide the walls and roof with a backing material such that the walls and roof have sufficient strength and stiffness to give the structure the desired shape. The separable fasteners can be attached to the structure and to the base by any appropriate method known in the art, such as by sewing them or adhering them with an adhesive material.

The toy is used by spreading the base on a generally flat surface, such as a table or floor, and then unfolding the structures into expanded form (FIGS. 2–4) and placing them on the base in any desired location. Optionally, the structures may be coupled to the base by means of the fasteners.

The subject matter claimed is:

1. A toy comprising:

(a) a base comprising a fabric sheet painted or printed such that one or more portions thereof resemble at least one member selected from the group consisting of grass, streets, rivers, lakes, railroad tracks, sidewalks, and airport runways;

(b) at least one structure configured for being reversibly folded into a flattened shape and unfolded into a shape representing a member selected from the group consisting of houses, garages, businesses, farm buildings, churches, schools, transportation terminals, trees, and mountains, wherein said at least one structure is optionally configured for being releasably attached to said base; and (c) at least one separable fastener comprising first and second portions thereof, wherein said first portion is disposed on said base and said second portion is disposed on said at least one structure.

2. The toy of claim 1 wherein said separable fastener comprises a hook-and-loop fastener.

3. The toy of claim 1 wherein said fabric comprises a woven fabric.

4. The toy of claim 3 wherein said woven fabric comprises canvas or heavy cotton duck.

5. A method for using a toy comprising a base comprising a flexible sheet and at least one structure configured for being reversibly folded into a flattened shape and unfolded into a shape representing a member selected from the group consisting of houses, garages, farm buildings, churches, schools, transportation terminals, trees, and mountains, wherein said at least one structure is optionally configured for being releasably attached to said base, comprising:

(a) spreading the base on a generally flat surface;

(b) unfolding said at least one structure such that said at least one structure comprises a shape representing a member selected from the group consisting of houses, garages, businesses, farm buildings, churches, schools, transportation terminals, trees, and mountains; and (c) placing said unfolded at least one structure at a selected location on the base.

6. The method of claim 5 further comprising:

(d) attaching said unfolded at least one structure at a selected location on the base.

7. The method of claim 6 wherein said attaching comprises using a separable fastener.

8. The method of claim 7 wherein said separable fastener comprises a hook-and-loop fastener.

9. A toy comprising:

(a) a base comprising a flexible sheet;

(b) at least one structure configured for being reversibly folded into a flattened shape and unfolded into a shape representing a member selected from the group consisting of houses, garages, businesses, farm buildings, churches, schools, transportation terminals, trees, and mountains, wherein said at least one structure is optionally configured for being releasably attached to said base; and (c) said base comprises means for releasably attaching said at least one structure.

10. The toy of claim 9 wherein said base is painted or printed such that one or more portions thereof resemble at least one member selected from the group consisting of grass, streets, rivers, lakes, railroad tracks, sidewalks, parking lots, and airport runways.

11. The toy of claim 9, wherein said means for releasably attaching comprises a first component of a separable fastener.

12. The toy of claim 10, where in said first component of a separably fastener comprises a component of a hook-and-loop fastener.

13. The toy of claim 9 wherein said base is comprised of a fabric.

14. The toy of claim 13 wherein said fabric comprises a woven fabric.

15. The toy of claim 14 wherein said woven fabric comprises canvas or heavy cotton duck.

* * * * *